United States Patent [19]

Beck

[11] 4,407,106

[45] Oct. 4, 1983

[54] COMPLEX COLUMN

[75] Inventor: René A. Beck, Pully, Switzerland

[73] Assignee: Gram S.A., Fribourg, Switzerland

[21] Appl. No.: 249,364

[22] Filed: Mar. 31, 1981

[30] Foreign Application Priority Data

May 16, 1980 [CH] Switzerland ..... 3829/80

[51] Int. Cl.[3] ..... E04C 3/34

[52] U.S. Cl. ..... 52/722; 52/725; 52/726; 264/311

[58] Field of Search ..... 52/724, 725, 723, 722, 52/727, 726; 264/310, 311, 312, 253

[56] References Cited

U.S. PATENT DOCUMENTS

| | | | |
|---|---|---|---|
| 869,724 | 10/1907 | Nichols | 52/722 |
| 1,011,195 | 12/1911 | Harry | 52/725 |
| 1,436,577 | 11/1922 | Cvetkovich | 52/722 |
| 1,573,735 | 2/1926 | Nelson | 52/722 |
| 2,198,985 | 4/1940 | Bailey | 52/725 |
| 2,566,689 | 9/1951 | Whiting | 264/311 |
| 3,003,290 | 10/1961 | Lerner | 52/724 |
| 3,145,811 | 8/1964 | Strehan | 52/725 |
| 3,352,120 | 11/1967 | Pelzer | 52/724 |
| 3,652,756 | 3/1972 | van Buren | 264/311 |
| 4,347,019 | 8/1982 | Metz | 52/727 |

FOREIGN PATENT DOCUMENTS

| | | | |
|---|---|---|---|
| 567865 | 3/1924 | France | 52/722 |
| 875253 | 9/1942 | France | 52/722 |
| 519394 | 3/1955 | Italy | 52/723 |
| 100127 | 6/1916 | United Kingdom | 52/725 |
| 126797 | 5/1919 | United Kingdom | 52/725 |
| 241753 | 10/1925 | United Kingdom | 52/725 |
| 386108 | 1/1933 | United Kingdom | 52/722 |
| 1264302 | 2/1972 | United Kingdom | 52/724 |

*Primary Examiner*—John E. Murtagh
*Assistant Examiner*—Henry E. Raduazo
*Attorney, Agent, or Firm*—Young & Thompson

[57] ABSTRACT

The invention relates to a complex column comprising a metallic core (1) embedded in a mass of concrete (2). This core (1) is accessible from the outside of the concrete mass (2) at each end of the column for its assembly to a structure.

8 Claims, 3 Drawing Figures

COMPLEX COLUMN

The present invention has for its object a complex column intended to be used more particularly in constructions having a metallic structure or in reinforced concrete constructions.

In such constructions, the pillars which are commonly formed of I or H metallic profiles have to be embedded, generally in concrete, as safeguard against fire risks. In fact in case of fire if the metallic carrying pillars are not protected from the heat, they are deformed and cause distortions or even the collapse of the supporting metallic structure of the construction.

Now the pillars and other exposed portions of the metallic structure of a construction are embedded in concrete after the setting in place of the structure. This necessites the realisation of casings around the pillars in particular and the pouring of concrete therein. Thereafter it is necessary to wait for the setting of the concrete. These operations are lengthy and onerous.

The present invention has for its object a complex carrying column tending to obviate these drawbacks by the fact that it comprises a core constituted by a metallic profile which is embedded in a mass of concrete and by the fact that the core emerges at both ends of the pillar from the concrete mass.

The attached drawings show schematically and by way of example two embodiments of the complex column according to the invention.

The carrying complex column according to the invention comprises a core 1 constituted by a metallic profile having the shape of an I or an H embedded in a mass of concrete 2. At both ends of the complex column the core 1 emerges from the concrete mass. The complex column can thus be connected to other elements of a metallic structure, by welding for example. These ends are then embedded in concrete during the pouring of a flooring slab.

Figure 1:
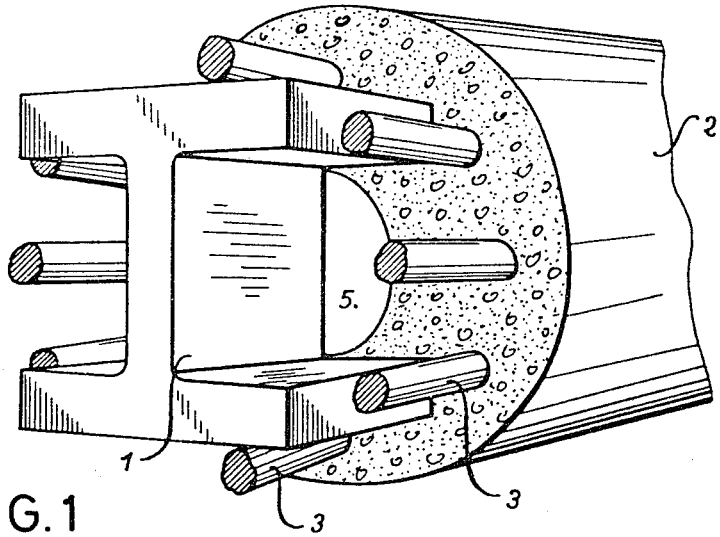
FIG. 1 shows in perspective view the end of a first embodiment of the complex column.
Figure 2:
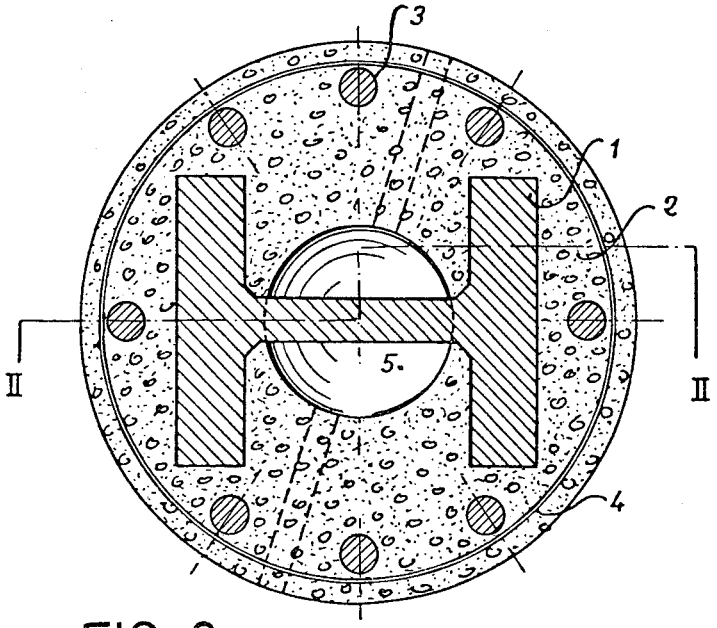
FIG. 2 is a transverse cross section of a variant of the complex column along line III—III of FIG. 3.

As shown in FIG. 1, armatures 3 are embedded in the mass of concrete 2 and merges out of it. Metallic hoops 4 (FIG. 2) can surround the armature 3 and provide for a good anchoring of these armatures in the slab for example.

The mass of concrete 1 is tubular and the complex column has therefore a central void 5 extending the whole height of the column. This central void 5 can be separated into two parts by the metallic profile. Such an internal void can be obtained only by the casting of the concrete followed by its centrifugation.

Figure 3:
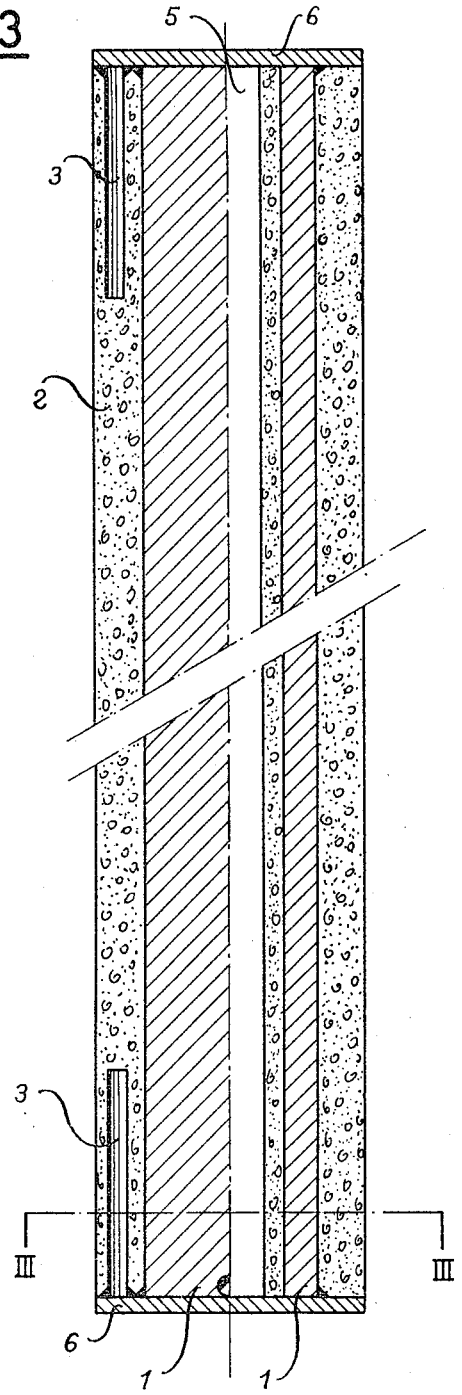
FIG. 3 is a longitudinal cross section along line II—II of the complex column shown in FIG. 2.

In the variant shown in FIG. 3, the end of the core 1 and of the armature 3 of the complex column are welded to a metallic end plate 6 used as base or supporting element for the column.

Numerous assembling modes can be provided to fix two complex columns together as a complex column to a metallic structure or to an armed concrete structure. Therefore the invention resides in the fact that the armatures emerge from out of the mass of concrete or are at least accessible from the outside of said mass at both ends of the columns in order to be either welded to metallic elements or embedded in a concrete flooring slab.

It is evident that the cross section of the complex column can be not only circular as shown but also polygonal, square, rectangular or of other shape.

This type of complex column can also be used with advantage in a concrete construction where the pillars have absolutely to be of small dimensions despite the high loading.

The setting in place of the concrete by centrifugation is particularly important and of interest to obtain high resistance columns still having a small outside diameter and provided with an internal void which can be used to locate ducts.

While the invention has been described in detail and with reference to specific embodiments thereof, it will be apparent to one skilled in the art that various changes and modifications can be made therein without departing from the spirit and scope thereof.

What is claimed is:

1. In a complex column comprising a core formed of a metal profile embedded in a mass of concrete, both ends of the core being exposed at the ends of the column; the improvement in which said column has a hollow center extending the length said column, said core having a web that is exposed within and extends across the hollow center of the column, the interior and exterior surfaces of the column apart from the core being of exposed concrete.

2. A column as claimed in claim 1, in which the cross section of the column is annular, the column having an outer cylindrical surface of concrete and two inner part-cylindrical surfaces of concrete separated by said web.

3. A column as claimed in claim 1, in which the core is a steel beam having a web that extends across and divides the hollow interior of the column into two equal spaces, the beam having at least one flange extending perpendicular to the web and embedded in the concrete.

4. A column as claimed in claim 3, said beam being an H-beam having both flanges embedded in the concrete.

5. A column as claimed in claim 1, and steel rods extending lengthwise of the column and embedded in the concrete.

6. A column as claimed in claim 1, the ends of said core being flush with the ends of the column.

7. A column as claimed in claim 6, and end plates welded to the ends of the core.

8. A column as claimed in claim 1, in which the core extends beyond the concrete at both ends of the column.

* * * * *